United States Patent [19]

Theurer et al.

[11] Patent Number: 4,457,234

[45] Date of Patent: Jul. 3, 1984

[54] TRACK LIFTING AND LINING DEVICE

[75] Inventors: Josef Theurer, Vienna; Johann Pichler, Strassham, both of Austria

[73] Assignee: Franz Plasser Bahnbaumaschinen Industrie Gesellschaft m.b.H., Vienna, Austria

[21] Appl. No.: 253,105

[22] Filed: Apr. 13, 1981

[30] Foreign Application Priority Data

May 29, 1980 [AT] Austria ..... 2871/80

[51] Int. Cl.³ ..... E01B 27/17

[52] U.S. Cl. ..... 104/7 B; 104/12

[58] Field of Search ..... 104/7 B, 7 R, 1 R, 8, 104/12

[56] References Cited

U.S. PATENT DOCUMENTS

| | | | |
|---|---|---|---|
| 3,808,976 | 5/1974 | Stewart | 104/12 |
| 3,832,952 | 9/1974 | Hurni | 104/7 B |
| 3,949,678 | 4/1976 | Theurer | 104/12 |
| 3,968,752 | 7/1976 | Theurer | 104/7 B |
| 4,046,078 | 9/1977 | Theurer | 104/7 R |
| 4,069,763 | 1/1978 | Theurer | 104/12 |
| 4,094,251 | 6/1978 | Theurer | 104/12 |
| 4,323,013 | 4/1982 | Theurer | 104/7 B |

FOREIGN PATENT DOCUMENTS

| | | | |
|---|---|---|---|
| 1581071 | 9/1969 | France | 104/7 R |
| 2020718 | 11/1979 | United Kingdom | 104/7 B |

*Primary Examiner*—Randolph Reese

*Attorney, Agent, or Firm*—Kurt Kelman

[57] ABSTRACT

A mobile track leveling and lining machine comprises a frame and a track lifting and lining device which comprises a rigid tool carrier including a pulling member rigidly connected to the carrier, the pulling member having a free end linked to the frame, and two track lifting tools associated with each track rail and spacedly mounted on the tool carrier. A single pair of flanged wheels arranged between the two track lifting tools serves as lining tools and mounts the tool carrier on a common axle for mobility on the track rails. A power-actuated lifting drive is associated with each track rail and links an end of the tool carrier opposite to the frame end for pivotal movement in all directions to the frame, the lifting drives being arranged to lift the track vertically, and a power-actuated lining drive links the tool carrier to the frame and is arranged to move the track in a transverse direction.

13 Claims, 6 Drawing Figures

TRACK LIFTING AND LINING DEVICE

The present invention relates to a mobile track leveling and lining machine arranged for mobility on the rails of a track in an operating direction and comprises a frame, and more particularly to an improved track lifting and lining device mounted on the frame.

U.S. Pat. No. 3,832,952, dated Sept. 3, 1974, discloses a mobile track leveling, lining and tamping machine with a track lifting and lining device which comprises a beam-shaped tool carrier extending transversely to the track and a pair of flanged wheels mounts the tool carrier on a common axis for mobility on the track rails and serves as lining tools. Lifting hooks are vertically adjustably mounted on the carrier ends and face the flanged wheels, the rails being gripped between the flanged wheels and the hooks. Two lifting drives connect the ends of the tool carrier to the machine frame and two lining drives connect a center portion of the carrier to the machine frame. Additionally, an intermediate carriage supports each lifting hook for vertical adjustment on the carrier by means of a power-actuated drive and the flanged wheels are laterally displaceable in a horizontal plane by means of a power-actuated drive to press them selectively against the insides of the rails, the flanged wheels being also spring-biased in relation to the carrier. The outer ends of the tool carrier are furthermore linked to the machine frame by longitudinally adjustable jacks and a center rod links the center of the tool carrier to the machine frame to keep the carrier at a constant distance with respect to the machine frame and serves as a pulling member for the carrier. This enables the beam-shaped tool carrier to be properly centered by slightly pivoting the carrier about a vertical axis in a track curve. Such a track lifting and lining device has a complex structure and the many movable parts are subject to malfunction and tend to provide unsatisfactory guidance of the tool carrier along the track rails so that the lifting and lining tools will not always properly engage the rails during a leveling and/or lining operation. Furthermore, the three-point connection of the tool carrier to the machine frame by means of the outer jacks and the center rod provide neither an automatic centering of the carrier in a track curve nor an accurate radial alignment of the carrier in the arc defined by the track curve. This must be accomplished by operation of the jacks. The entire structure is relatively unstable and cannot provide a good and solid guidance and engagement of the tools with the track rails.

In the track leveling, lining and tamping machine of U.S. Pat. No. 4,248,154, dated Feb. 3, 1981, the lifting and lining tool carrier is guided acurately along the track rails by a pair of spaced-apart flanged wheels engaging each rail. The carrier is pulled along in the operating direction by a pulling member whose center is linked to the machine frame by a universal joint. A lifting hook is pivotally and vertically adjustably mounted intermediate each pair of flanged wheels for engagement with the outside of each rail. The lining drive is linked to the machine frame above each axle of the tool carrier and two lifting drives link the carrier to the machine frame for raising the track which is securely engaged between the flanges of the flanged wheels and the lifting hooks. This secure three-point rail engagement and the pivotal lifting hook arrangement enable this machine to be used for lifting heavy switches and crossings.

The track surfacing machine of U.S. Pat. No. 4,094,251, dated June 13, 1978, is equipped with a lifting and lining device which comprises two independent lifting and lining tools per rail. The tool carrier is glidably supported on vertical guide columns and is pivotal about a vertical axis, a carrier arm supporting a pair of lifting rollers and a pair of double-flanged wheels therebetween for each rail. A lifting drive links the carrier arm to the machine frame. If only one lifting tool engages the rails or the two lifting tools engage the rail with a different force, the tool carrier is subjected to torque, requiring the entire device to be very large and strong. Similar leveling and lining devices are used in the track surfacing machines disclosed in U.S. Pat. No. 3,895,583, dated July 22, 1975, and U.S. Pat. No. 3,949,678, dated Apr. 13, 1976.

It is the primary object of this invention to provide a track leveling and lining machine with a simplified lifting and lining device which may be more accurately guided along the track rails in all operating conditions and whose lifting tools engage the track rails securely and in a stable position.

The above and other objects are accomplished according to the invention with a track lifting and leveling device which comprises a rigid tool carrier including a pulling member rigidly connected to the carrier and having a free end linked to the frame. Two track lifting tools are associated with each track rail and are spacedly mounted on the tool carrier in the operation direction. A single pair of flanged wheels is arranged between the two track lifting tools and mounts the tool carrier on a common axle for mobility on the track rails. A power-actuated lifting drive is associated with each track rail and links an end of the tool carrier opposite the free end for pivotal movement in all directions to the frame, the lifting drives being arranged to lift the track substantially vertically in relation to the track, and a power-actuated lining drive links the tool carrier to the frame and is arranged to move the track in a transverse direction.

Because the tool carrier is suspended on the machine frame on both sides by the power-actuated lifting drives each of which is associated with a respective rail, the tool carrier arrangement is very stable and the movability of the carrier in all directions enables the tools to engage the rails even in the most difficult positions and the carrier to be guided accurately along the track rails. The use of a single pair of flanged wheels causes the carrier to be automatically centered and to be radially aligned, thus assuring the identical engagement conditions for the lifting tools in engagement with the track rails. Even if only one of the track lifting tools engages the rail, no torque will be transmitted to the carrier because the track lifting tools are arranged between the two ends of the carrier which are linked to the machine frame for universal movement.

The above and other objects, advantages and features of the present invention will become more apparent from the following detailed description of certain now preferred embodiments thereof, taken in conjunction with the accompanying somewhat schematic drawing wherein.

Figure 1:
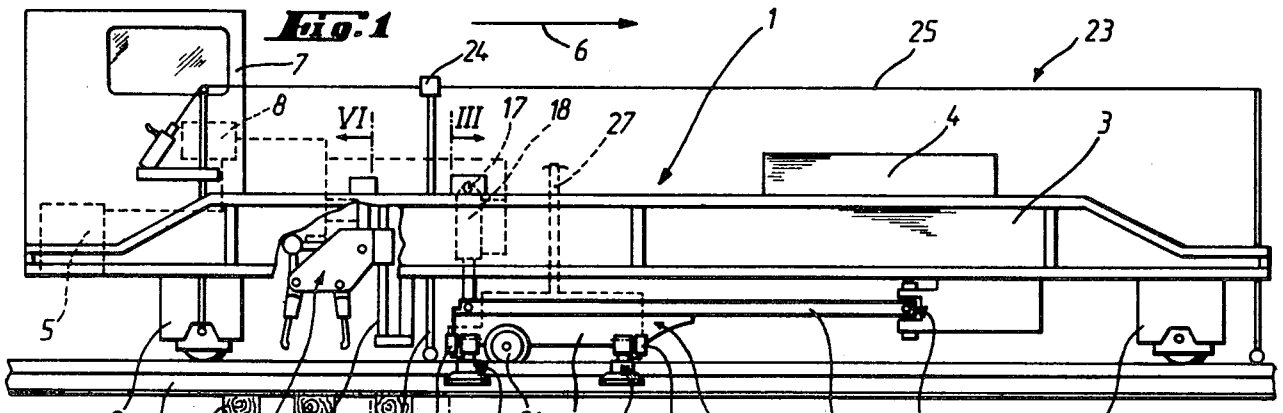
FIG. 1 is a side elevation view of a track leveling, lining and tamping machine equipped with a track lifting and linking device according to this invention.

Referring now to the drawing and first to FIG. 1, there is shown a generally conventional track leveling, lining and tamping machine 1 comprising frame 3 supported on undercarriages 2, 2 for mobility on rails 10 in an operating direction indicated by arrow 6. The track consists of two rails 10 fastened to ties 9 and machine frame 3 carries power plant 4 including a source of electric and hydraulic power and transmission 5 for transmitting the power to the wheels of rear undercarriage 2 and various movable parts and tools mounted on the machine. The operation of the machine is controlled by an operator in cab 7 in which control board 8 is mounted. In the illustrated embodiment, all power-actuated drives are hydraulic drives.

Rearwardly of the track lifting and lining device, as seen in the operating direction, machine frame 3 carries tamping head 12 associated with each track rail 10 and vertically adjustably mounted on the frame by vertical guide columns 11 between undercarriages 2, 2.

The track lifting and lining device of the invention is shown to comprise rigid tool carrier 13 including bifurcated tool carrying portion 14 and pole 15 rigidly connected to, and projecting from, the tool carrying portion and having a free end linked to frame 3 by universal joint 16 for movement of the free end in all directions. The illustrated tool carrying portion has the form of a yoke and the pole is a tension or pulling member and extends substantially centrally between the track rails in the direction thereof, universal joint 16 being mounted on frame 3 and connecting the free end of the pulling member to the frame. The tool carrying portion 14 supports lifting tools 19, 20 and pulling member 15 is rigidly connected thereto opposite to the free end. This simple and robust carrier structure is particularly space-saving while assuring great stabiltiy.

Two track lifting tools 19, 20 are associatd with each track rail 10 and are spacedly mounted on tool carrier 13 in the operating direction. In the embodiment shown in FIGS. 1 and 2, the track lifting tools are comprised of roller discs and power-actuated drives 26 pivotally mount the roller discs on the tool carrier portion 14 for engagement with, and disengagement from, a respective outside of track rails 10. The lifting tools are pivotal in a vertical plane extending transversely to the track.

A single pair of flanged wheels 21 is arranged between the two track lifting tools and mounts the tool carrier on a common axle for mobility on the track rails.

A power-actuated lifting drive 18, illustrated as a hydraulic jack, is associated with each track rail 10 and links an end of tool carrier 13 opposite the free end thereof for pivotal movement in all directions to frame 3, the lifting drives being arranged to lift the track substantially vertically in relation to the track, and power-actuated lining drive 30 links the tool carrier to the frame and is arranged to move the track in a transverse direction. As shown in the illustrated preferred embodiment, rear track lifting tools 19, as seen in the operating direction, are positioned below track lifting jacks 18 and the rear lifting tools and associated jacks substantially define a common axis. Universal joints 17 link the upper ends of the lifting jacks to machine frame 3.

Using pivotal roller discs as lifting tools enables the lifting tools to remain continuously engaged with the associated rails and mounting such pivotal roller discs on a tool carrier which is linked at both ends by a universal joint to the machine frame assures a high accuracy with great efficiency. Mounting the rear lifting tools substantially coaxially with the lifting drives greatly reduces or eliminates any flexing stress on the tool carrier by the lifting drives. The second lifting tool for the rail may be held in engagement therewith on tangent track for added safety in keeping the track fully engaged during lifting or may be used at abutting rail ends connected by fishplates or similar points.

Flanged wheels 21 serve as track lining tools and are arranged immediately adjacent rear track lifting tools 19, as seen in the operating direction, in the preferred embodiment illustrated herein. This arrangement excludes any differences in the levels of the lifting and lining tools which engage the respective sides of the track rails and would lead to undesirable flexing of the tool carrier, particularly in the range of switches involving heavy track structures, where only the rear lifting tool is used.

As is well known in the leveling and lining of track, leveling system 23 comprises rail sensing rod 22 running on each rail 10 and moving vertically in response to the sensed level of the rail. The rail level sensing rod carries a potentiometer 24 on its upper end, which is in contact with tensioned reference wire 25 and generates a control signal proportional to the rail level. This control signal is transmitted to control 8 which operates lifting jacks 18 in response to the signal.

Hydraulic jacks 26 are respectively linked to the tool carrier portion 14 and lifting tools 19, 20 for pivoting the tools into and out of engagement with rail 10, hydraulic fluid supply lines 27 connecting jacks 26 to hydraulic fluid source 5 and also being operated from control 8.

Figure 2:
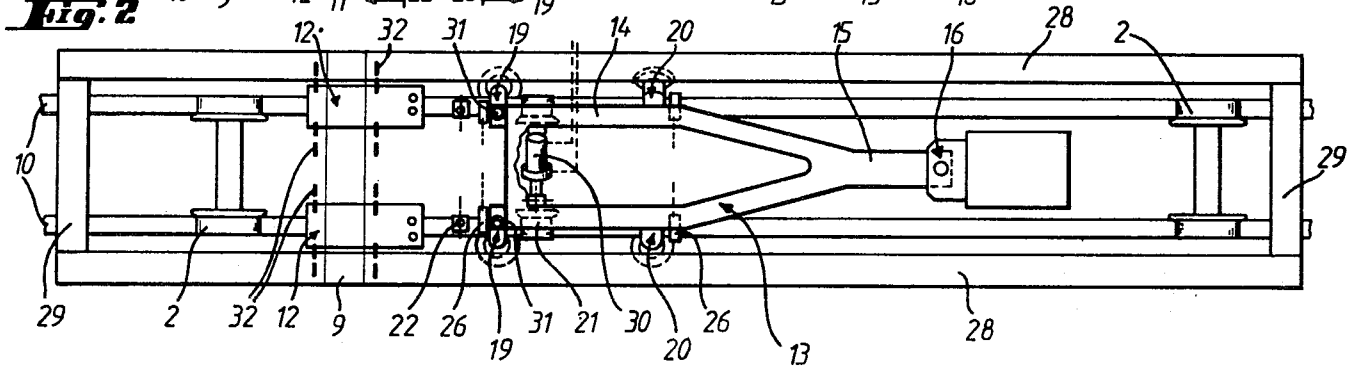
FIG. 2 is a top view of FIG. 1.

As shown in FIG. 2, machine frame 3 of the preferred embodiment is constituted by a rectangular frame including two longitudinally extending beams 28, 28 and transversely extending beams 29, 29 encompassing all the tools of the machine, including tamping heads 12 and tool carriers 13. Hydraulic lining jack 30 is mounted in a vertical plane defined by the common axle of flanged wheels 21, the jack cylinder being linked to machine frame 3 while the piston rod of the jack is linked to tool carrier portion 14. Three of the lifting tools 19, 20 are shown in FIG. 2 in engagement with track rails 10 while the left front tool 20 is illustrated pivoted out of engagement with the associated track rail. The lower ends of lifting jacks 18 are linked to tool carrier portion 14 at 31, above rear lifting tools 19.

Respective tamping head 12 is associated with each track rail and is vertically adjustably mounted on machine frame 3 by guide columns 11, each tamping head, as schematically indicated in FIG. 2, having a series of cooperating tamping tools 32 arranged to be immersed in the ballast alongside respective ties 9 and to tamp ballast under the ties.

With the arrangement of the rectangular frame, which extends in a plane and encompasses all operating parts of the machine, all requirements for a rigid machine frame are met with a minimum of structural parts while all operating parts are well protected from exterior mechanical forces.

Figure 3:
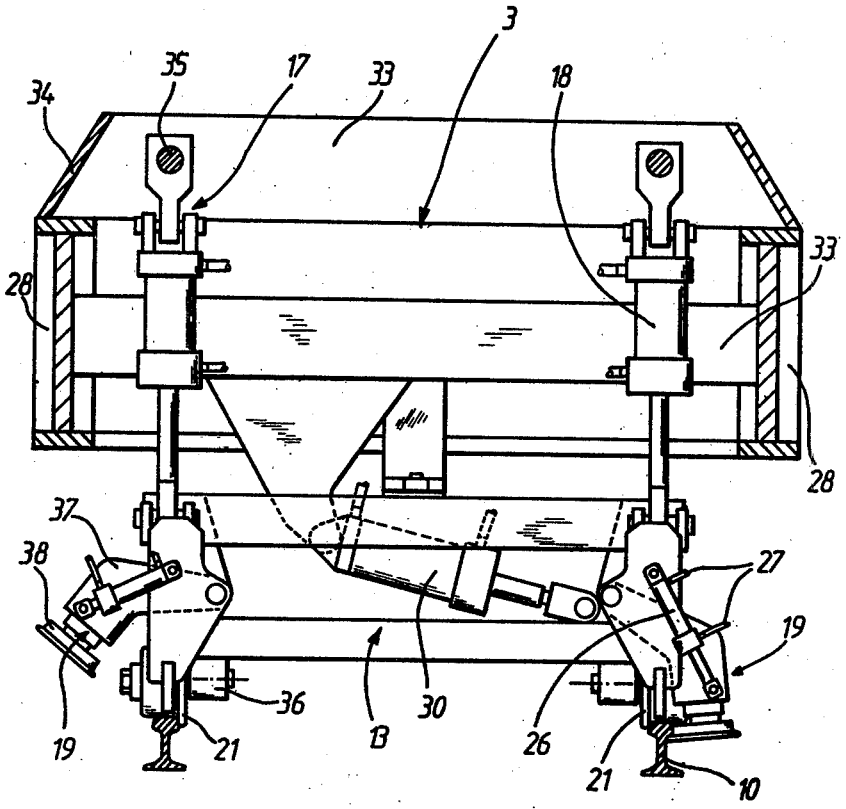
FIG. 3 is an enlarged end view of the device, taken along line III—III of FIG. 1.

FIG. 3 shows the lifting and leveling device of FIGS. 1 and 2 in greater detail. I-beams 28, 28 are braced by cross beams 33, upper cross beam 33 carrying universal joints 17 linking the upper end of lifting drives 18 to machine frame 3 while one end of lining drive 30 is linked to a bracket mounted on lower cross beam 33. Upper cross beam 33 is comprised of two mirror-symmetrically arranged U-supports connected by plates 34 and bolts 35 which form a part of universal joints 17. Tool carrier 13 has one end linked to the machine frame by universal joint 16 (see FIGS. 1 and 2) while its other end is linked to lifting drives 18 to the machine frame at 31. Stub axles 36 mount flanged wheels 21 on the tool carrier and the flanged wheels guide the carrier along track rails 10. FIG. 3 shows left rear lifting tool 19 pivoted out of engagement with the track rail while right lifting tool 19 is in engagement with rail 10.

The illustrated lifting tools comprise carrier arm 37 pivotal in a transverse vertical plane about a pivot extending substantially parallel to the track rails and equipped at its free end opposite the pivot with roller disc 38. Hydraulic jack 26 links each lifting tool carrier arm to the tool carrier and may be remote-controlled from control 8 for independently controlling the vertical adjustment of the track lifting tools. This enables respective lifting tools to be engaged with, and disengaged from, the associated rails for best adaptation to particular track configurations. If desired, the roller discs may remain engaged with the rails while the machine advances along the track.

Figure 4:
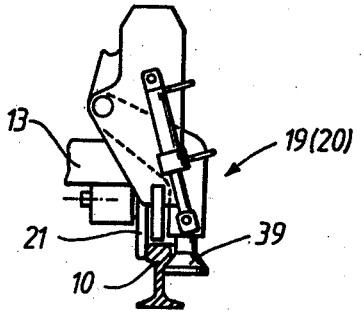
FIGS. 4 and 5 illustrate two different embodiments of lifting tools.
Figure 5:
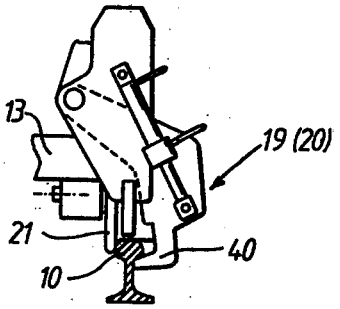

FIGS. 4 and 5 illustrate further embodiments of lifting tools that may be used in the track lifting and leveling device of the present invention. In a functionally equivalent manner to the flanged roller discs described hereinabove, the lifting tools shown in these figures also are comprised of vertically adjustable elements capable of subtending the rail heads for engaging the track rails. In the embodiment of FIG. 4, these elements are rotatably mounted mushroom-shaped members 39 having heads capable of subtending the rail heads. In the embodiment of FIG. 5, there are hooks 40 capable of being pivoted into engagement with the outside of rails 10. These type of lifting tools will be particularly useful as lifting tools in track switch areas and/or if the track to be lifted is embedded in a heavily encrusted ballast bed.

Figure 6:
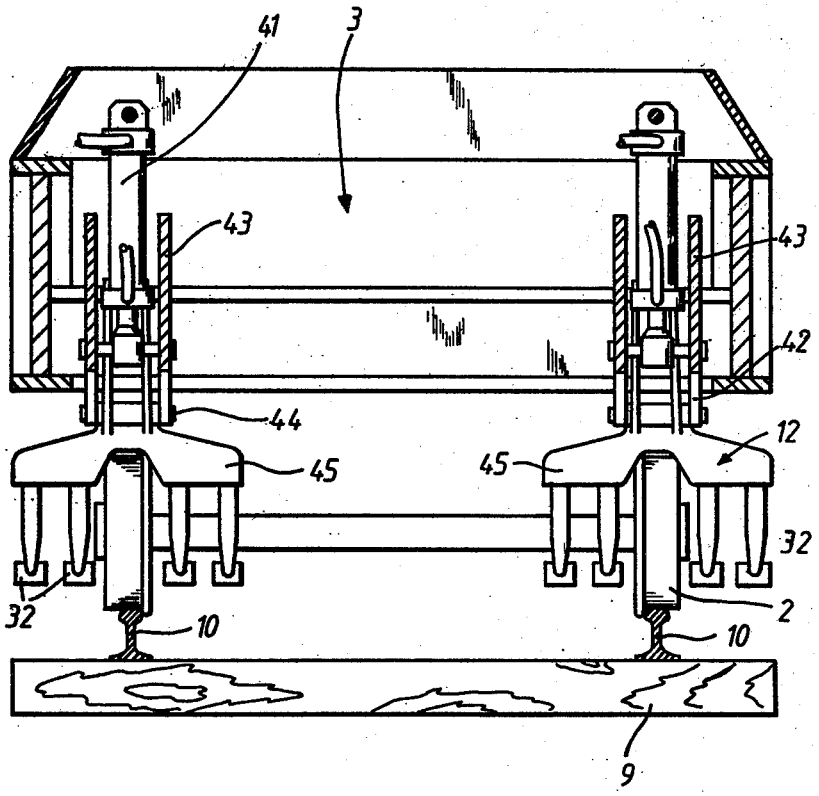
FIG. 6 is an enlarged end view of the tamping heads, taken along line VI—VI of FIG. 1.

Preferred tamping heads associated with rails 10 are illustrated in FIG. 6. As shown, each tamping head 12 comprises tool carrier 43 which is vertically movably mounted on machine frame 3 by hydraulic jack 41. Tamping tool means 45 extends transversely to associated rail 10 and straddles the track rail symmetrically in relation thereto so that the tamping tool means forms a rigid fork with two tamping tools 32 arranged at each side of the rail. Transversely extending pivot 44 mounts the tamping tool means on tool carrier 43. The outer tamping tool means portion is covered by longitudinal frame beam 28 so that all tamping tools 32 are protected. This arrangement provides a very simple structure while enabling the tamping tools to be vertically moved below the machine frame in the required manner.

The operation of the illustrated track tamping, leveling and lining machine will partly be obvious from the above description of its structure and will be set forth in additional detail hereinbelow.

As soon as the operator in cab 7 actuate hydraulic jacks 26 to engage selected lifting tools 19, 20 with the outsides of track rails 10, the track rails are firmly gripped to tool carrier 13 between the flanges of lining tools 21 and the engaged lifting tools. Lifting drives 18 are then actuated in response to a control signal from reference signal emitter 24 to lift tool carrier 13 correspondingly and thus to level the track gripped thereby until the control signal indicates that the track has been lifted to the desired level and actuation of lifting drives 18 is accordingly discontinued. The lifted track is then fixed in its leveled position by actuation, the tamping tools to tamp the ballast under the lifted track ties. After tamping is completed and tamping heads 12 are raised to move the tamping tool jaws out of the ballast, control 8 will remove the hydraulic fluid pressure from drives 18 and the machine is advanced a step to the next tie. During this advancement of machine 1, lifting tools 19, 20 may remain engaged with the associated track rails. The machine is stopped when tamping heads 12 are centered over the next tie and the leveling operation described hereinabove is repeated. At a rail joint, where abutting rail ends are connected by fishplates, front lifting tools 20 are pivoted by jacks 26 out of engagement with the rails and the track lift is provided only by rear lifting tools 19. When the rear lifting tools are pivoted out of engagement in the range of the rail joint, the front lifting tools are again engaged with the rails. In this manner, it is possible to grip the track rails continuously with the lifting tools and to keep the track raised during tamping at the leveled position. Under all operating conditions, the rigid lifting and lining tool carrier whose ends are linked to the machine frame by universal joints enables the lifting and lining tools to be in firm and accurate engagement with the track rails, regardless of whether one or two lifting tools engage each rail. Furthermore, the stability of the device is not influenced by the specific type of lifting tools used, i.e. it remains assured whether roller discs, mushroom-shaped members or hooks are used in adaptation to the specific track structure being lifted.

What is claimed is:

1. A mobile track leveling and lining machine arranged for mobility on the rails of a track in an operating direction and comprising a frame and a track lifting and lining device comprising (a) a rigid tool carrier extending in the direction of the track and including a tool carrying portion having the form of a bifurcated yoke and a rigid pulling member integral with, and rigidly connected to, the tool carrying portion, the pulling member being a pole extending substantially centrally between the track rails in the direction thereof and having a free end directly linked to the frame for universal pivoting movement, (b) a track lifting tool associated with each track rail and mounted on the tool carrying portion, (c) a single pair of flanged wheels mounting the tool carrier on a common axle for mobility on the track rails, (d) a power-actuated lifting drive associated with each track rail and linking an end of the tool carrier opposite the free end for universal pivotal movement in all directions to the frame, the lifting drives being arranged to lift the track substantially vertically in relation to the track and the flanged wheels being arranged on the tool carrying portion between the lifting drives and the free end of the rigid pulling member, and (e) a power-actuated lining drive linking the tool carrier to the frame and arranged to move the track in a transverse direction.

2. The mobile track leveling and lining machine of claim 1, further comprising means for tamping ballast supporting the track.

3. The mobile track leveling and lining machine of claim 1, wherein two of said track lifting tools are associated with each track rail, the two track lifting tools associated with each track rail are mounted on the tool carrying portion spaced from each other in the operating direction, and the flanged wheels are arranged between the two track lifting tools associated with each rail.

4. The mobile track leveling and lining machine of claim 3, wherein a rear one of the track lifting tools, associated with each track rail, as seen in the operating direction, and the associated lifting drive substantially have a common axis.

5. The mobile track leveling and lining machine of claim 4, wherein the flanged wheels serve as track lining tools and are arranged immediately adjacent the rear track lifting tools, as seen in the operating direction.

6. The mobile track leveling and lining machine of claim 3, wherein at least the front track lifting tools, as seen in the operating direction, are comprised of roller discs and power-actuated drives pivotally mounting the roller discs on the tool carrying portion for engagement with, and disengagement from, a respective outside of the track rails.

7. The mobile track leveling and lining machine of claim 6, wherein the rear track lifting tools, as seen in the operating direction, are comprised of vertically adjustable elements capable of subtending the rail heads for engaging the track rails.

8. The mobile track leveling and lining machine of claim 7, wherein the vertically adjustable elements are hooks.

9. The mobile track leveling and lining machine of claim 8, wherein the vertically adjustable elements are mushroom-shaped members having heads capable of subtending the rail heads.

10. The mobile track leveling and lining machine of claim 1, further comprising independently controllable power-actuated drives vertically adjustably mounting the track lifting tools on the tool carrying portion.

11. The mobile track leveling and lining machine of claim 1, further comprising a tamping head associated with each track rail and vertically adjustably mounted on the frame, each tamping head having a series of cooperating tamping tools, the frame being constituted by a rectangular frame including two longitudinally extending beams and encompassing all the tools, and the tamping tools extending laterally into vetical planes defined by the longitudinal beams of the frame.

12. The mobile track leveling and lining machine of claim 11, wherein the tamping head comprises a tool carrier, tamping tool means extending transversely to the associated track rail and straddling the track rail symmetrically in relation thereto, the tamping tool means having a portion arranged outside the track rail and a portion arranged inside the track rail, the outer tamping tool means portion being covered by the longitudinal frame beam, and a transversely extending pivot mounting the tamping tool means on the tool carrier, and further comprising a vertical support column slidably mounting the tool carrier on the frame for vertical adjustment of the tamping head.

13. The mobile track leveling and lining machine of claim 1, comprising a universal joint mounted on the frame for connecting the free end of the rigid pulling member to the frame.

* * * * *